US009068462B2

(12) United States Patent
Cui et al.

(10) Patent No.: US 9,068,462 B2
(45) Date of Patent: Jun. 30, 2015

(54) PROCESS OF WELDING A TURBINE BLADE, A PROCESS OF WELDING A NON-UNIFORM ARTICLE, AND A WELDED TURBINE BLADE

(75) Inventors: Yan Cui, Greenville, SC (US); Srikanth Chandrudu Kottilingam, Simpsonville, SC (US); Brian Lee Tollison, Greenville, SC (US); Dechao Lin, Greenville, SC (US); David Edward Schick, Greenville, SC (US); George Meng, Greenville, SC (US)

(73) Assignee: General Electric Company, Schenectady, NY (US)

( * ) Notice: Subject to any disclaimer, the term of this patent is extended or adjusted under 35 U.S.C. 154(b) by 957 days.

(21) Appl. No.: 13/234,224

(22) Filed: Sep. 16, 2011

(65) Prior Publication Data

US 2013/0071250 A1 Mar. 21, 2013

(51) Int. Cl.
*F01D 5/14* (2006.01)

(52) U.S. Cl.
CPC ..... *F01D 5/141* (2013.01); *F05D 2230/232* (2013.01)

(58) Field of Classification Search
CPC ..... B23K 2201/001; B23K 2201/00; B23K 9/032; B23K 9/028; B23K 15/0053; B23K 26/28; B23K 26/30
USPC ..... 416/223 A, 223 R; 228/178, 182; 219/121.14, 121.64, 75, 121.11, 219/121.36, 121.45, 121.46, 121.59, 125.1, 219/136, 137 R
See application file for complete search history.

(56) References Cited

U.S. PATENT DOCUMENTS

| | | | | |
|---|---|---|---|---|
| 5,071,059 | A * | 12/1991 | Heitman et al. | 228/244 |
| 2007/0221705 | A1 * | 9/2007 | Arnett et al. | 228/101 |
| 2010/0089877 | A1 * | 4/2010 | Ohta et al. | 219/74 |

* cited by examiner

*Primary Examiner* — Edward Look
*Assistant Examiner* — Maxime Adjagbe
(74) *Attorney, Agent, or Firm* — McNees Wallace & Nurick LLC

(57) ABSTRACT

A process of welding an article and a welded turbine blade are disclosed. The process includes fusion welding over a primary symmetry line determined from a center of gravity on a first side of the article or blade and fusion welding over the primary symmetry line determined from the center of gravity on a second side of the article or blade. The fusion treating includes multiple fusion treatments.

20 Claims, 3 Drawing Sheets

PROCESS OF WELDING A TURBINE BLADE, A PROCESS OF WELDING A NON-UNIFORM ARTICLE, AND A WELDED TURBINE BLADE

FIELD OF THE INVENTION

The present invention is directed to processes of fabricating manufactured articles and a manufactured article. In particular, the present invention is directed to processes for fusion welding and a fusion welded article.

BACKGROUND OF THE INVENTION

The operating temperature within a gas turbine is both thermally and chemically hostile. Advances in high temperature capabilities have been achieved through the development of iron, nickel, and cobalt-based superalloys and the use of environmental coatings capable of protecting superalloys from oxidation, hot corrosion, etc.

In the compressor portion of a gas turbine, atmospheric air is compressed to 10-25 times atmospheric pressure, and adiabatically heated to 700° F.-1250° F. (371° C.-677° C.) in the process. This heated and compressed air is directed into a combustor, where it is mixed with fuel. The fuel is ignited, and the combustion process heats the gases to very high temperatures, in excess of 3000° F. (1650° C.). These hot gases pass through the turbine, where airfoils fixed to rotating turbine disks extract energy to drive an attached generator which produces electrical power. To improve the efficiency of operation of the turbine, combustion temperatures have been raised. Of course, as the combustion temperature is raised, steps must be taken to prevent thermal degradation of the materials forming the flow path for these hot gases of combustion.

Many hot gas path articles are fabricated using welding processes. It is desirable for weld joints in or around such articles to have increased operational properties such as crack resistance. Concentrated and non-distributing thermal and/or residual stress along such welds can result in decreased operational properties.

A process of fusion joining a non-uniform article, such as a turbine blade, to distribute thermal and/or residual stress and a non-uniform article having such features would be desirable in the art.

BRIEF DESCRIPTION OF THE INVENTION

In an exemplary embodiment, a process of welding a turbine blade includes fusion joining a suction side along a first path extending over a primary symmetry line determined from a center of gravity of the turbine blade and fusion joining a pressure side along a second path extending over the primary symmetry line determined from the center of gravity of the turbine blade. The fusion joining includes multiple fusion joining processes.

In another exemplary embodiment, a process of joining a non-uniform article includes fusion welding a first side along a first path extending over a primary symmetry line determined from a center of gravity of the non-uniform article, fusion welding a second side along a second path over the primary symmetry line determined from the center of gravity of the non-uniform article, the first side opposing the second side, and identifying the center of gravity by suspending the template of an exact cross section of the non-uniform article from a first point proximal to the first side and suspending the non-uniform article from a second point proximal to an edge extending between the first side and the second side. The fusion welding includes multiple fusion welding processes.

In another exemplary embodiment, a turbine blade includes a pressure side and a suction side, a first overlap fusion welding region on the pressure side extending over a primary symmetry line determined from a center of gravity of the turbine blade, and a second overlap fusion welded region on the suction side extending over the primary symmetry line determined from the center of gravity of the turbine blade. The first overlap fusion welding region and the second overlap fusion welding region are formed by multiple fusion welding processes.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a joining process and a joined article having distributed thermal and/or residual stress along and near the joining region such as a weld, base metal adjacent to the weld. Embodiments of the present disclosure increase crack resistance, decrease crack propensity, increase crack resistance in areas of non-uniform geometry, increase crack resistance in thick sections of a work piece, reduce residual stresses in weld joints through offsetting of shrinkage forces, decrease distortion, decrease costs by reducing or eliminating the use of random welding trials, and combinations thereof.

Figure 1:
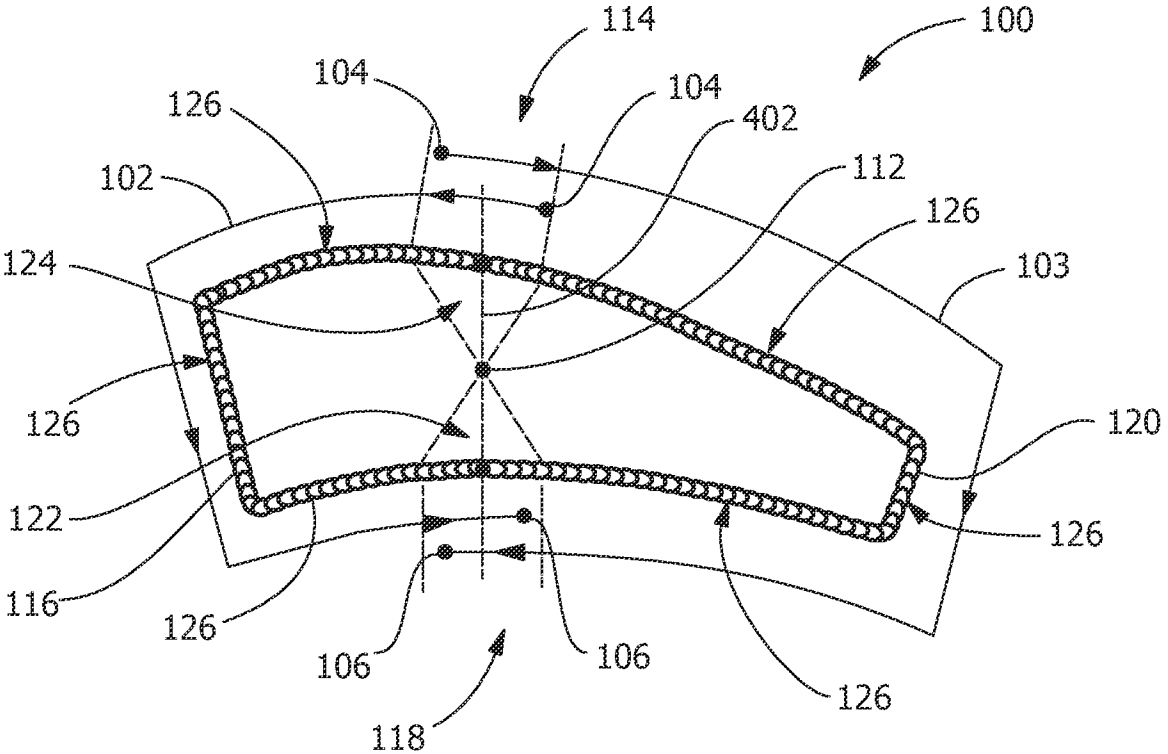
FIG. 1 is a schematic view of an exemplary turbine blade according to the disclosure showing multiple fusion joining paths and multiple overlap fusion joining regions.

Referring to FIG. 1, a welding sequence includes joining an article, such as a turbine blade 100, along multiple paths, such as a first joining path 102 and a second joining path 103 shown in FIG. 1, along a perimeter, such as a circumference, to join the article. The first joining path 102 and the second joining path 103 divide the article into two segments, two being a first overlap joint fusion region 122 and a second overlap fusion joint region 124 and two being complex geometry single-pass regions 126. In further embodiments, four fusion welding paths or more fusion welding paths are used for larger or more complicated articles. The fusion welding is by laser beam welding, electron beam welding, tungsten arc welding, any other suitable fusion joining method, or combinations thereof. In one embodiment, the article has a non-uniform geometry, such as the turbine blade 100 for a gas turbine, a steam turbine, or another suitable turbine. In one embodiment, the article has a predetermined thickness, for example, between about 100 mils and about 1000 mils, between about 200 mils and about 800 mils, and about 300 mils and about 700 mils, of about 300 mils, of about 400 mils, of about 500 mils, or of about 600 mils.

The first fusion welding path 102 and the second fusion welding path 103 each include a start location 104 and a stop location 106. The joining sequence reduces thermal and residual stress of the turbine blade 100 based upon the positioning of the start location(s) 104 and the stop location(s) 106. In one embodiment, the start locations 104 for each of the first joining path 102 and the second joining path 103 are on the same side of the turbine blade 100. For example, in one embodiment, the start location 104 is on a suction side 114 of the turbine blade 100. Additionally or alternatively, in one embodiment, the stop locations 106 for each of the first joining path 102 and the second joining path 103 are on the same side of the turbine blade 100, for example, a pressure side 118 of the turbine blade 100.

Figure 2:
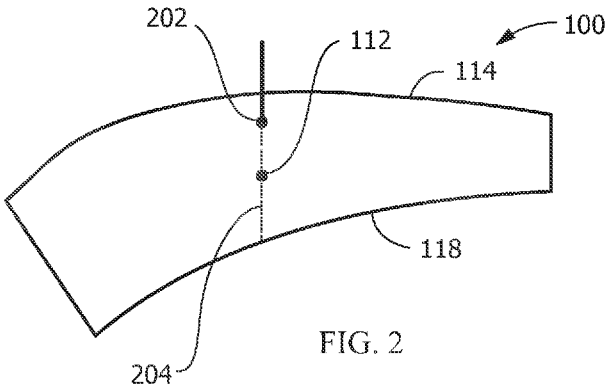
FIG. 2 is a schematic view of a turbine blade having a transverse component of a center of gravity of the turbine blade being identified according to the disclosure.
Figure 3:
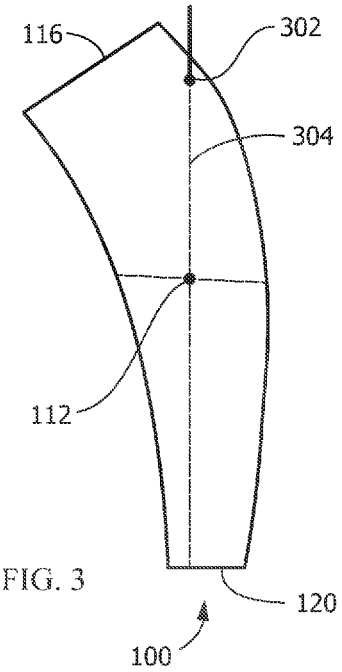
FIG. 3 is a schematic view of a turbine blade having a cross-sectional component of a center of gravity of the turbine blade being identified according to the disclosure.

Referring to FIG. 2, a transverse component of a center of gravity 112 of the turbine blade 100 is determined, for example, by suspending the template of the exact cross section of turbine blade 100 from a first point 202, such as an opening, proximal to a first edge, such as the suction side 114 of the turbine blade 100, and distal from a second edge, such as the pressure side 118 of the turbine blade 100. Referring to FIG. 3, next, a cross-sectional component of the center of gravity 112 of the turbine blade 100 is determined, for example, by suspending the template of the exact cross section of turbine blade 100 from a second point 302 proximal to a third edge, such as a leading edge 116 of the turbine blade 100, and distal from a fourth edge, such as a trailing edge 120 of the turbine blade 100. A transverse line 204 (see FIG. 2) illustrating the transverse component of the center of gravity 112 and a cross-sectional line 304 (see FIG. 3) illustrating the cross-sectional component of the center of gravity 112 are extended through the turbine blade 100 to intersect at the center of gravity 112.

Figure 4:
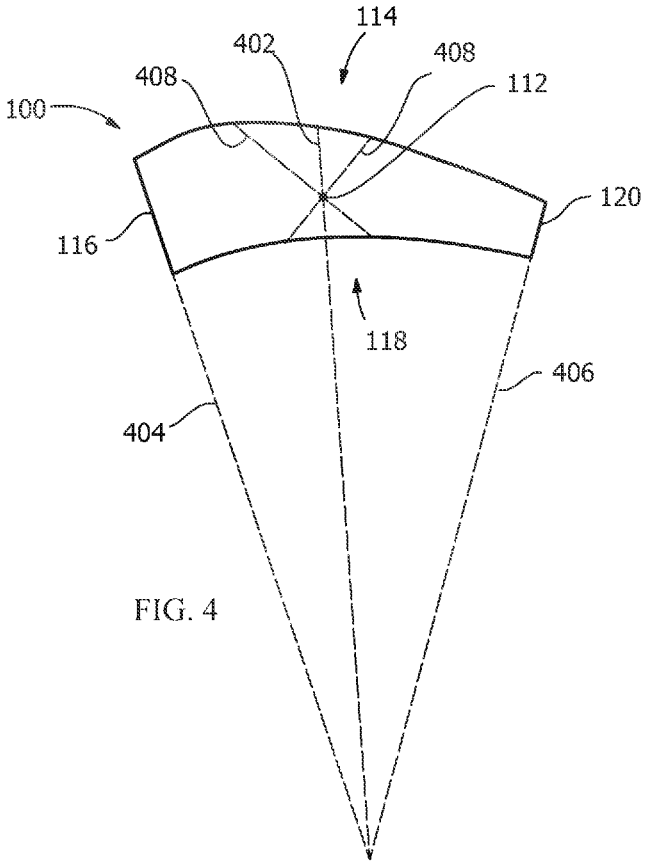
FIG. 4 is a schematic view of a turbine blade having a primary symmetry line of the turbine blade being identified according to the disclosure.

Referring to FIG. 4, the leading edge 116 and the trailing edge 120 of the turbine blade 100 are used to determine a primary symmetry line 402 by extending a leading line 404 from the leading edge 116, extending a trailing line 406 from the trailing edge 120 and extending the primary symmetry line 402 from the intersection of the leading line 404 and the trailing line 406 through the center of gravity 112. In one embodiment, the trailing edge 120 and/or the leading edge 116 include(s) a non-linear geometry, such as curved. In this embodiment, the leading line 404 and/or the trailing line 406 extend tangentially to the non-linear geometry. In one embodiment, one or more secondary symmetry lines 408 are then identified.

The primary symmetry line 402 corresponds to the position of the start locations 104 (see FIG. 1) and/or stop locations 106 (see FIG. 1) of the first fusion welding path 102 and the second fusion welding path 103 (see FIG. 1). In one embodiment, the start locations 104 of the first fusion welding path 102 and the second fusion welding path 103 are positioned such that the first fusion welding path 102 and the second fusion welding path 103 result in fusion welding of the suction side 114 and/or the pressure side 118 over the primary symmetry line 402. For example, in one embodiment, one of the first fusion welding path 102 and the second fusion welding path 103 extends from the suction side 114 of the turbine blade 100, over the primary symmetry line 402 on the suction side 114, to and along the leading edge 116 of the turbine blade 100, to and along the pressure side 118 of the turbine blade 100, and over the primary symmetry line 402 on the pressure side 118. In another embodiment, one of the first fusion joining path 102 and the second fusion welding path 103 extends from the pressure side 118 of the turbine blade 100, over the primary symmetry line 402 on the pressure side 118, to and along the trailing edge 120 of the turbine blade 100, to and along the suction side 114 of the turbine blade 100, and over the primary symmetry line 402 on the suction side 114. Additionally or alternatively, in one embodiment, the start location(s) 104 and/or the stop location(s) 106 are positioned along the secondary symmetry lines 408.

Referring again to FIG. 1, according to an exemplary embodiment, the turbine blade 100 formed from the exemplary process includes the pressure side 118 and the suction side 114, a first overlap fusion welding region 122 on the pressure side 118 extending over the primary symmetry line 402 based upon the center of gravity 112 of the turbine blade 100, and a second overlap fusion welded region 124 on the suction side 114 extending over the primary symmetry line 402 based upon the center of gravity 112 of the turbine blade 100. The first overlap fusion welding region 122 and the second overlap fusion welding region 124 are formed by multiple fusion welding processes. The first overlap fusion welding region 122 and/or the second overlap fusion welding region 124 are defined by the start locations 104 and the stop locations 106. In further embodiments, the first overlap fusion welding region 122 and/or the second overlap fusion welding region 124 extend between secondary symmetry lines 408, are identifiable based upon single-pass regions 126, are on the same side of the turbine blade 100, such as the suction side 114 or the pressure side 118, or combinations thereof.

In one embodiment, the turbine blade 100 is formed of, in whole or in part, a superalloy material. A suitable superalloy material is a nickel-based alloy having, by weight, up to about 15% chromium, up to about 10% cobalt, up to about 4% tungsten, up to about 2% molybdenum, up to about 5% titanium, up to about 3% aluminum, and up to about 3% tantalum. In one embodiment, the superalloy material has a composition by weight of about 14% chromium, about 9.5% cobalt, about 3.8% tungsten, about 1.5% molybdenum, about 4.9% titanium, about 3.0% aluminum, about 0.1% carbon, about 0.01% boron, about 2.8% tantalum, and a balance of nickel.

Another suitable superalloy material is a nickel-based alloy having, by weight, up to about 10% chromium, up to about 8% cobalt, up to about 4% titanium, up to about 5% aluminum, up to about 6% tungsten, and up to about 5% tantalum. In one embodiment, the superalloy material has a composition, by weight, of about 9.75% chromium, about 7.5% cobalt, about 3.5% titanium, about 4.2% aluminum, about 6.0% tungsten, about 1.5% molybdenum, about 4.8% tantalum, about 0.08% carbon, about 0.009% zirconium, about 0.009% boron, and a balance of nickel.

Another suitable superalloy material is a nickel-based alloy having, by weight, up to about 8% cobalt, up to about 7% chromium, up to about 6% tantalum, up to about 7% aluminum, up to about 5% tungsten, up to about 3% rhenium and up to about 2% molybdenum. In one embodiment, the superalloy material has a composition, by weight, of about 7.5% cobalt, about 7.0% chromium, about 6.5% tantalum, about 6.2% aluminum, about 5.0% tungsten, about 3.0% rhenium, about 1.5% molybdenum, about 0.15% hafnium, about 0.05% carbon, about 0.004% boron, about 0.01% yttrium, and a balance of nickel.

Another suitable superalloy material is a nickel-based alloy having, by weight, up to about 10% chromium, up to about 8% cobalt, up to about 5% aluminum, up to about 4% titanium, up to about 2% molybdenum, up to about 6% tungsten and up to about 5% tantalum. In one embodiment, the superalloy material has a composition, by weight, of about 9.75% chromium, about 7.5% cobalt, about 4.2% aluminum, about 3.5% titanium, about 1.5% molybdenum, about 6.0% tungsten, about 4.8% tantalum, about 0.5% niobium, about 0.15% hafnium, about 0.05% carbon, about 0.004% boron, and a balance of nickel.

Another suitable superalloy material is a nickel-based alloy having, by weight, up to about 10% cobalt, up to about 8% chromium, up to about 10% tungsten, up to about 6% aluminum, up to about 3% tantalum and up to about 2% hafnium. In one embodiment, the superalloy material has a composition, by weight, of about 9.5% cobalt, about 8.0% chromium, about 9.5% tungsten, about 0.5% molybdenum, about 5.5% aluminum, about 0.8% titanium, about 3.0% tantalum, about 0.1% zirconium, about 1.0% carbon, about 0.15% hafnium and a balance of nickel.

Figure 5:
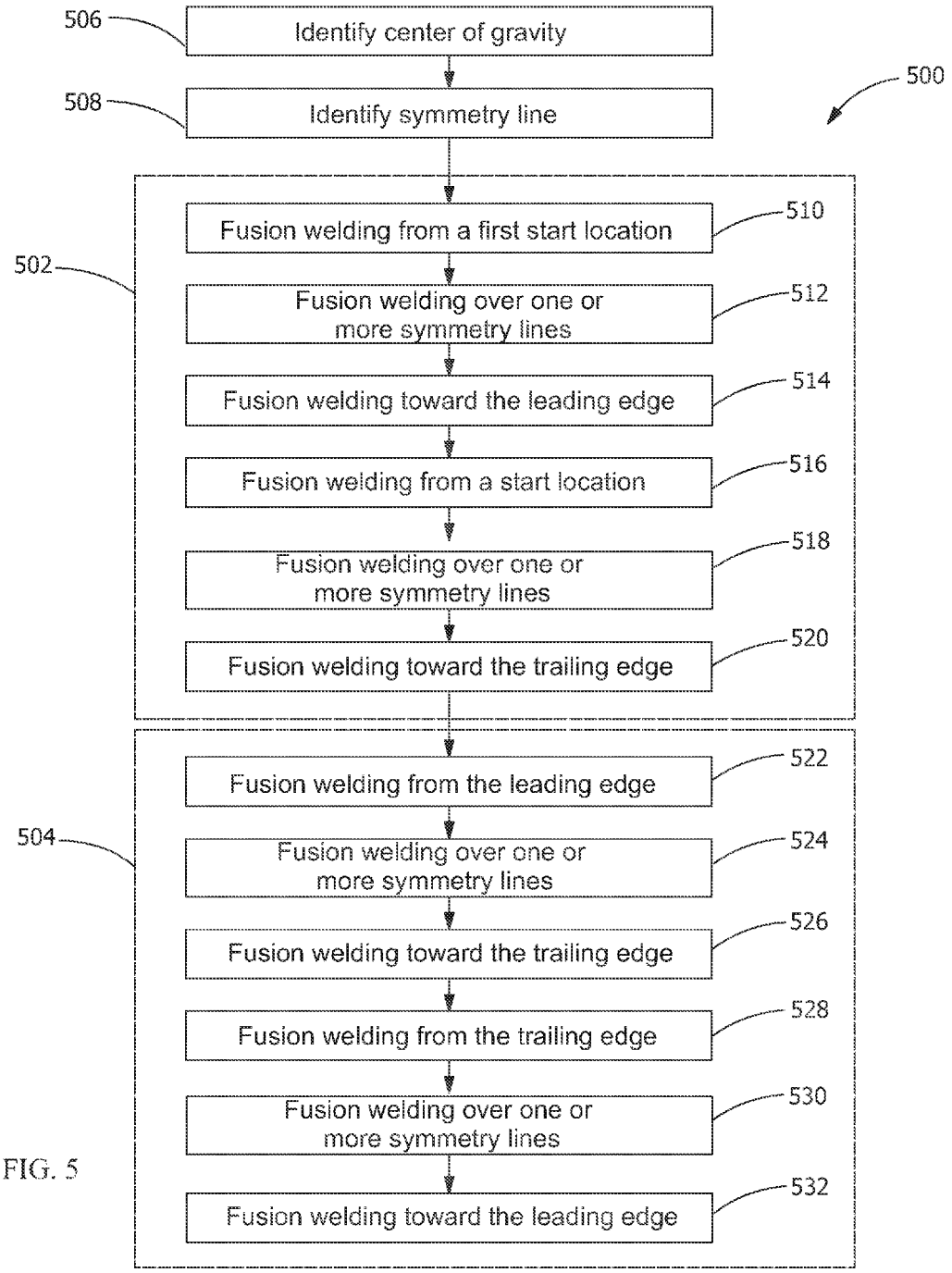
FIG. 5 is a flow diagram of an exemplary process of joining a turbine blade according to the disclosure.

FIG. 5 illustrates an exemplary process 500 of welding a non-uniform article such as the turbine blade 100. The process includes a step of fusion welding the suction side 114 (step 502), for example, along a path, for example, the first fusion welding path 102 and/or the second fusion welding path 103, extending over the primary symmetry line 402 determined from the center of gravity 112 of the turbine blade 100. The process 500 further includes a step of fusion welding the pressure side 118 (step 504), for example, along a path, for example, the first fusion welding path 102 and/or the second fusion welding path 103, extending over the primary symmetry line 402 determined from the center of gravity 112 of the turbine blade 100. Portions of the fusion welding of the suction side 114 (step 502) and the fusion welding of the pressure side 118 (step 504) each include multiple fusion welding processes.

In one embodiment, the fusion welding of the suction side 114 (step 502) is performed first and the fusion welding of the pressure side 118 (step 504) is performed second. In another embodiment, the fusion welding of the suction side 114 (step 502) is performed second and the fusion welding of the pressure side 118 (step 504) is performed first. In yet another embodiment, the fusion welding of the suction side 114 (step 502) and the fusion welding of the pressure side 118 (step 504) are performed at least partially at the same time.

Referring to FIGS. 4 and 5, in one embodiment, the fusion welding of the suction side 114 (step 502) includes fusion welding from a first start location (substep 510), such as the start location 104 on the suction side 114 proximal to the trailing edge 120, then fusion welding over one or more symmetry lines (substep 512), such as one or more of the secondary symmetry lines 408 and/or the primary symmetry line 402 on the suction side 114, and then fusion welding toward the leading edge (substep 514) and/or onto the leading edge 116. In one embodiment, these substeps are all performed along the first fusion welding path 102 (see FIG. 1).

The fusion welding of the suction side 114 (step 502) further includes fusion welding from a second start location (substep 516), such as the start location 104 on the suction side 114 proximal to the leading edge 116, then fusion welding over one or more symmetry lines (substep 518), such as the one or more of the secondary symmetry lines 408 and/or the primary symmetry line 402 on the suction side 114, and then fusion welding toward the trailing edge (substep 520) and/or onto the trailing edge 120. In one embodiment, these substeps are all performed along the second fusion welding path 102 (see FIG. 1).

The fusion welding of the pressure side 118 (step 504) includes fusion welding from the leading edge 116 (substep 522), then fusion welding over one or more symmetry lines (substep 524), such as one or more of the secondary symmetry lines 408 and/or the primary symmetry line 402 on the pressure side 118, and then fusion welding toward the trailing edge (substep 526) and/or onto the trailing edge 120. In one embodiment, these substeps are all performed along the first fusion welding path 102 (see FIG. 1). In another embodiment, these substeps are all performed separate and prior to the fusion welding of the first fusion welding path 102.

The fusion welding of the pressure side 118 (step 504) further includes fusion welding from the trailing edge 120 (substep 528), then fusion welding over one or more symmetry lines (substep 530), such as the one or more of the secondary symmetry lines 408 and/or the primary symmetry line 402 on the pressure side 118, and then fusion welding toward the leading edge (532) and/or onto the leading edge 116. In one embodiment, these substeps are all performed along the second fusion welding path 102 (see FIG. 1). In another embodiment, these substeps are all performed separate and prior to the fusion welding of the first fusion welding path 102.

Alternatively, the fusion welding of the suction side 114 (step 502) and the fusion welding of the pressure side 118 (step 504) are reversed. In other embodiments, third fusion welding paths (not shown), fourth fusion welding paths (not shown), or additional or preliminary fusion treatment paths extend in either of these directions to fusion welding the suction side 114 and/or the pressure side 118.

In one embodiment, the process 500 further includes steps prior to the fusion welding. For example, in one embodiment, the process 500 includes identifying the center of gravity 112 (step 506), for example, by suspending template of the exact cross section of the turbine blade 100 from the first point 202 proximal to the suction side 114 and suspending template of the cross section of the turbine blade 100 from the second point 302 proximal to the leading edge 116 or the trailing edge 120 of the turbine blade 100. Similarly, in another embodiment, the process 500 further includes identifying the primary symmetry line 402 and/or secondary symmetry lines 408 (step 508), for example, by extending a first line, for example, the leading line 404, from the leading edge 116 of the turbine blade 100, extending a second line, for example, the trailing line 406, from the trailing edge 120 of the turbine blade 100, identifying the intersection point of the first line and the second line, and extending a line, for example, the primary symmetry line 402, from the intersection point through the center of gravity 112.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A process of welding a turbine blade, the process comprising:

identifying the center of gravity of the turbine blade;

fusion welding a suction side along a first path extending over a primary symmetry line determined from the center of gravity of the turbine blade; and fusion welding a pressure side along a second path extending over the primary symmetry line determined from the center of gravity of the turbine blade;

wherein the fusion welding includes multiple fusion welds.

2. The process of claim 1, wherein the identifying of the center of gravity is by suspending a template of an exact cross section of the turbine blade from a first location proximal to the suction side or the pressure side and suspending the turbine blade from a second location proximal to a leading edge or a trailing edge of the turbine blade.

3. The process of claim 1, further comprising identifying the primary symmetry line by extending a first line from a leading edge of the turbine blade, extending a second line from a trailing edge of the turbine blade, identifying an intersection point of the first line and the second line, and extending a line from the intersection point through the center of gravity.

4. The process of claim 3, wherein one or both of the leading edge and the trailing edge are non-linear, and wherein one or both of the first line and the second line extend tangential to the turbine blade.

5. The process of claim 1, wherein the fusion welding of the suction side and the fusion welding of the pressure side are performed by fusion welding along a first fusion welding path and a second fusion welding path.

6. The process of claim 5, wherein the first fusion welding path extends from the suction side of the turbine blade, over the primary symmetry line on the suction side, to and along a leading edge of the turbine blade, to and along the pressure side of the turbine blade, and over the primary symmetry line on the pressure side.

7. The process of claim 5, wherein the first fusion welding path extends from the pressure side of the turbine blade, over the primary symmetry line on the pressure side, to and along a trailing edge of the turbine blade, to and along the suction side of the turbine blade, and over the primary symmetry line on the suction side.

8. The process of claim 1, wherein the fusion welding is laser welding or electron beam welding.

9. The process of claim 1, wherein the fusion welding of the suction side begins at a start location at a secondary symmetry line.

10. The process of claim 1, wherein the fusion welding of the pressure side ends at a stop location at a secondary symmetry line.

11. The process of claim 1, wherein the fusion welding of the pressure side begins at a start location at a secondary symmetry line.

12. The process of claim 1, wherein the fusion welding of the suction side ends at a stop location at a secondary symmetry line.

13. A process of welding a non-uniform article, the process comprising:

fusion welding a first side along a first path extending over a primary symmetry line determined from a center of gravity of the non-uniform article;

fusion welding a second side along a second path over the primary symmetry line determined from the center of gravity of the non-uniform article, the first side opposing the second side; and identifying the center of gravity by suspending a template of an exact cross section of the non-uniform article from a first point proximal to the first side and suspending the non-uniform article from a second point proximal to an edge extending between the first side and the second side;

wherein the fusion welding includes multiple fusion welding processes.

14. A turbine blade, comprising:

a pressure side and a suction side;

a first overlap fusion welding region on the pressure side extending over a primary symmetry line determined from a center of gravity of the turbine blade; and a second overlap fusion welded region on the suction side extending over the primary symmetry line determined from the center of gravity of the turbine blade;

wherein the first overlap fusion welding region and the second overlap fusion welding region are formed by multiple fusion welding processes.

15. The turbine blade of claim 14, wherein the first overlap fusion welding region is laser welded.

16. The turbine blade of claim 14, wherein the first overlap fusion welding region is electron beam welded.

17. The turbine blade of claim 14, wherein the first overlap fusion welding region begins at a start location at a first secondary symmetry line.

18. The turbine blade of claim 17, wherein the first overlap fusion welding region ends at a stop location at a second secondary symmetry line.

19. The turbine blade of claim 17, wherein the second overlap fusion welding region begins at a start location at the first secondary symmetry line.

20. The turbine blade of claim 17, wherein the second overlap fusion welding region ends at a stop location at a second secondary symmetry line.

* * * * *